US011835071B2

(12) United States Patent
Zhou et al.

(10) Patent No.: US 11,835,071 B2
(45) Date of Patent: Dec. 5, 2023

(54) POWER SYSTEM FOR LIFTING APPARATUS

(71) Applicant: NORTH VALLEY RESEARCH, INC., Shandong (CN)

(72) Inventors: Binxin Zhou, Shanghai (CN); Shanrui Zhang, Shanghai (CN); Bo Deng, Shanghai (CN); Lin Zhang, Shanghai (CN)

(73) Assignee: NORTH VALLEY RESEARCH, INC., Shandong (CN)

( * ) Notice: Subject to any disclaimer, the term of this patent is extended or adjusted under 35 U.S.C. 154(b) by 1498 days.

(21) Appl. No.: 15/994,386

(22) Filed: May 31, 2018

(65) Prior Publication Data

US 2019/0002258 A1 Jan. 3, 2019

(30) Foreign Application Priority Data

May 31, 2017 (CN) ..... 201710405140.0

(51) Int. Cl.

| | |
|---|---|
| ***F15B 21/14*** | (2006.01) |
| ***B66F 9/22*** | (2006.01) |
| ***B66F 11/04*** | (2006.01) |
| ***F04B 17/03*** | (2006.01) |
| ***F04B 23/02*** | (2006.01) |

(52) U.S. Cl.

CPC ..... *F15B 21/14* (2013.01); *B66F 9/22* (2013.01); *B66F 11/04* (2013.01); *F04B 17/03* (2013.01); *F04B 23/02* (2013.01); *B66F 2700/09* (2013.01); *F15B 2211/20515* (2013.01); *F15B 2211/20569* (2013.01);

(Continued)

(58) Field of Classification Search

CPC ..... F15B 21/14; F15B 2211/20515; F15B 2211/20569; F15B 2211/20576; F15B 2211/2658; F15B 2211/7052; F15B 2211/7058; F15B 2211/761; B66F 9/22;

(Continued)

(56) References Cited

U.S. PATENT DOCUMENTS 6,005,360 A * 12/1999 Pace ..... B66F 9/22 91/361
8,246,008 B2 * 8/2012 De Jong ..... F15B 21/14 254/9 B (Continued)

FOREIGN PATENT DOCUMENTS

CN 203321761 U 12/2013
CN 106284478 A 1/2017

*Primary Examiner* — Dustin T Nguyen
(74) *Attorney, Agent, or Firm* — Muncy, Geissler, Olds & Lowe, P.C.

(57) ABSTRACT

A dynamic system for a lifting apparatus is disclosed. The dynamic system includes a first motor and a second motor decoupled from the first motor. During the ascent of the lifting apparatus, only the first motor is involved in the driving of the lifting apparatus. During the descent of the lifting apparatus, only the second motor is involved in charging the battery system. Since the first motor and the second motor are decoupled from each other, the first motor can have a high driving efficiency and the second motor can have a high power generation efficiency, the problem that when only one motor is adopted, the motor needs to balance between the driving efficiency and power generation efficiency is solved. The energy recovery rate of this invention can be increased from 10% in the prior art to about 30%.

12 Claims, 7 Drawing Sheets

(52) U.S. Cl.
CPC ..... *F15B 2211/20576* (2013.01); *F15B 2211/2658* (2013.01); *F15B 2211/7052* (2013.01); *F15B 2211/7058* (2013.01); *F15B 2211/761* (2013.01)

(58) Field of Classification Search
CPC ..... B66F 9/24; B66F 11/04; B66F 11/044; B66F 2700/09; F04B 17/03
See application file for complete search history.

(56) References Cited

U.S. PATENT DOCUMENTS 8,251,184 B2 * 8/2012 De Jong ..... B66F 7/16 187/210
8,538,612 B2 * 9/2013 Kawasaki ..... F15B 21/14 701/22
9,217,239 B2 * 12/2015 Hirozawa ..... E02F 9/128
9,518,593 B2 * 12/2016 Mori ..... E02F 9/2217
9,598,842 B2 * 3/2017 Imura ..... E02F 9/2075
9,790,963 B2 * 10/2017 Gomm ..... F15B 11/003
9,957,982 B2 * 5/2018 Ueda ..... F15B 11/0413
10,414,390 B2 * 9/2019 Morita ..... F01P 5/12
11,014,454 B2 * 5/2021 Bindl ..... B60L 50/14
11,628,727 B2 * 4/2023 Olsson ..... B60L 3/0046 318/34
2010/0096918 A1 * 4/2010 Sawada ..... B60L 58/22 307/9.1
2019/0003494 A1 * 1/2019 Ueda ..... B66F 9/22

* cited by examiner

POWER SYSTEM FOR LIFTING APPARATUS

CROSS-REFERENCES TO RELATED APPLICATIONS

This application claims the priority of Chinese patent application number 201710405140.0, filed on May 31, 2017, the entire contents of which are incorporated herein by reference.

TECHNICAL FIELD

The present invention relates to the technical field of lifting apparatuses, in particular to a dynamic system for a lifting apparatus.

BACKGROUND

Aerial platform vehicles have a wide range of applications. Generally, an aerial platform vehicle includes a cantilever crane arranged on a vehicle body and a work platform or working device installed at a tail end of the cantilever crane. A worker enters the work platform, and the work platform (or the working device) together with the worker is sent by the cantilever crane to a high place for aloft work. In a hydraulic system of the existing aerial platform vehicle, when the aerial platform vehicle descends from a high place, the descending speed is controlled by a throttle valve, resulting in a problem that potential energy released in the descending process is mostly consumed on the throttle valve, and the potential energy is converted into thermal heat of the hydraulic system. As a result, the temperature of oil of the system is increased, not only affecting the reliability of hydraulic elements which may render reduced work efficiency of the whole vehicle, but also wasting energy. Therefore, how to manufacture an aerial platform vehicle hydraulic energy recovery device which can recover and reuse the potential energy and hydraulic energy is a problem which urgently needs to be solved by those skilled in the art.

However, most of the current aerial platform vehicle hydraulic energy recovery technical schemes have the problems of great number of control elements, complex structure, low reliability and low motor recovery efficiency.

Therefore, there is a need to design a dynamic power system for a lifting apparatus with improved motor energy recovery efficiency.

SUMMARY OF THE INVENTION

The purpose of the present invention is to provide a dynamic system for a lifting apparatus to solve the problem of low motor energy recovery efficiency in the prior art.

To solve the above technical problem, the present invention provides a dynamic system for driving a lifting apparatus to ascend and descend, including a hydraulic cylinder, a liquid delivery system, a battery system, a motor control unit, a first motor, a second motor, a hydraulic pump system and a reservoir, wherein:

during the ascent of the lifting apparatus, the battery system provides power for the first motor through the motor control unit, the first motor drives the hydraulic pump system to rotate, the hydraulic pump system draws liquid from the reservoir and supplies the liquid to the liquid delivery system, the liquid delivery system supplies the liquid to the hydraulic cylinder, and the hydraulic cylinder converts hydraulic energy into mechanical energy to drive the lifting apparatus to ascend; and during the descent of the lifting apparatus, the mechanical energy of the dynamic system for the lifting apparatus is converted into hydraulic energy to make the liquid in the hydraulic cylinder flow to the liquid delivery system, the liquid flows to the hydraulic pump system through the liquid delivery system and drives the hydraulic pump system to rotate, the hydraulic pump system drives the second motor to rotate, and the second motor generates electricity and provides the generated electric energy for the battery system through the motor control unit, thereby charging the battery system.

In the dynamic system for the lifting apparatus according to the present invention, the first motor drives the hydraulic pump system to rotate and provides hydraulic energy for the hydraulic cylinder, so as to realize high driving efficiency of the dynamic system for the lifting apparatus. The hydraulic cylinder provides hydraulic energy for the hydraulic pump system to make the hydraulic pump system rotate and drive the second motor to rotate, so that the second motor generates electricity and charges the battery system, realizing high energy recovery efficiency of the dynamic system. Since the first motor and the second motor are decoupled from each other, the first motor can have a high driving efficiency and the second motor can have a high power generation efficiency, the problem that when only one motor is adopted, the motor needs to balance between the driving efficiency and power generation efficiency is solved. The energy recovery rate of the technical scheme can be increased from 10% in the prior art to about 30%.

Further, the hydraulic pump system in the present invention can implement two schemes. In one scheme, a single pump is used to control two motors, and the two motors can be coupled through any one of a coaxial linkage, a two-way gear pump plus a gear box, a single clutch or two separated clutches, or the like. In the other scheme, two pumps are used to control two motors, wherein the directions of liquid flowing through the two pumps are different, and the directions of rotation of the connected motors are also different.

Further, the liquid delivery system in the present invention can also realize single-channel or dual-channel liquid delivery. In a single-channel design, a two-way liquid valve and a flow control means may be adopted to lower the cost and simplify the channel design. In a dual-channel design, each channel may be provided with a one-way liquid valve, the two one-way liquid valves being in opposite directions, and the reliability of the entire system can be improved. In addition, a first pipe and a second pipe can be used to divert the liquid so as to simplify the control method.

In addition, various methods for connecting the two motors to the battery system can be adopted. Either two controllers or a single controller can be used to prevent the first motor and the second motor from being electrified at the same time, so as to avoid the occurrence of the wrong connection with positive and negative electrodes during motor driving and charging.

In the figures: 11—reservoir; 12—hydraulic cylinder; 2—hydraulic pump system; 21—first hydraulic pump; 22—second hydraulic pump; 23—third hydraulic pump; 31—first motor; 32—second motor; 33—first gear position; 34—second gear position; 35—first clutch device; 36—second clutch device; 4—liquid delivery system; 41—first valve; 42—second valve; 43—first throttle valve; 44—second throttle valve; 45—two-way solenoid valve; 5—battery system; 6—motor control unit; 61—first motor controller; 62—second motor controller; 63—third motor controller; 64—first motor interface; 65—second motor interface.

DETAILED DESCRIPTION OF EXEMPLARY EMBODIMENTS

A dynamic system for a lifting apparatus and a control method thereof provided by the present invention will be further described in detail with reference to the accompanying drawings and specific embodiments. The advantages and features of the present invention will be more apparent from the following description and claims. It should be noted that the drawings all adopt a very simplified form and all use non-precise proportions, and are only used to help illustrate the embodiments of the present invention conveniently and clearly.

Figure 1:
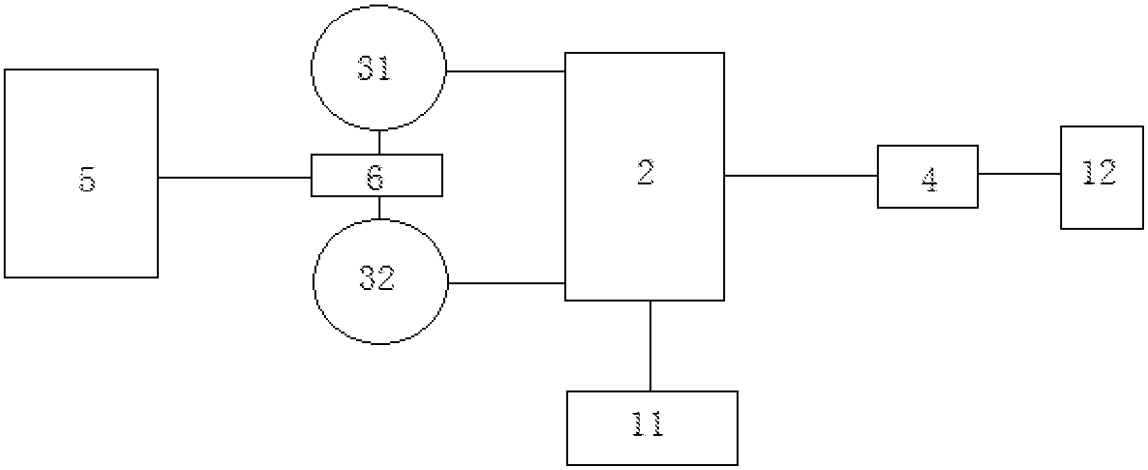
FIGS. 1-13 are schematic views of a dynamic system for a lifting apparatus according to the present invention.

The present invention provides a dynamic system for a lifting apparatus. As shown in FIG. 1, the dynamic system for the lifting apparatus is configured to drive the lifting apparatus to ascend and descend. The dynamic system for the lifting apparatus includes a hydraulic cylinder 12, a liquid delivery system 4, a battery system 5, a motor control unit 6, a first motor 31, a second motor 32, a hydraulic pump system 2 and a reservoir 11. During the ascent of the lifting apparatus, the battery system 5 provides power for the first motor 31 through the motor control unit 6, the first motor 31 drives the hydraulic pump system 2 to rotate, the hydraulic pump system 2 draws liquid from the reservoir 11 and supplies the liquid to the liquid delivery system 4, the liquid delivery system 4 supplies the liquid to the hydraulic cylinder 12 to increase liquid pressure in the hydraulic cylinder 12, and the hydraulic cylinder 12 converts hydraulic energy into mechanical energy to drive the lifting apparatus to ascend. During the descent of the lifting apparatus, the mechanical energy of the dynamic system for the lifting apparatus is converted into hydraulic energy, the liquid in the hydraulic cylinder 12 flows automatically to the liquid delivery system 4 under pressure caused by reduced volume of a cylinder body, the liquid flows to the hydraulic pump system 2 through the liquid delivery system 4, the hydraulic pump system 2 is driven by the flowing fluid to rotate, the hydraulic pump system 2 is connected with the second motor 32 and drives the second motor 32 to rotate, and the second motor 32 generates electric energy and provides the generated electric energy for the battery system 5 through the motor control unit 6, thereby charging the battery system 5.

Figure 2:
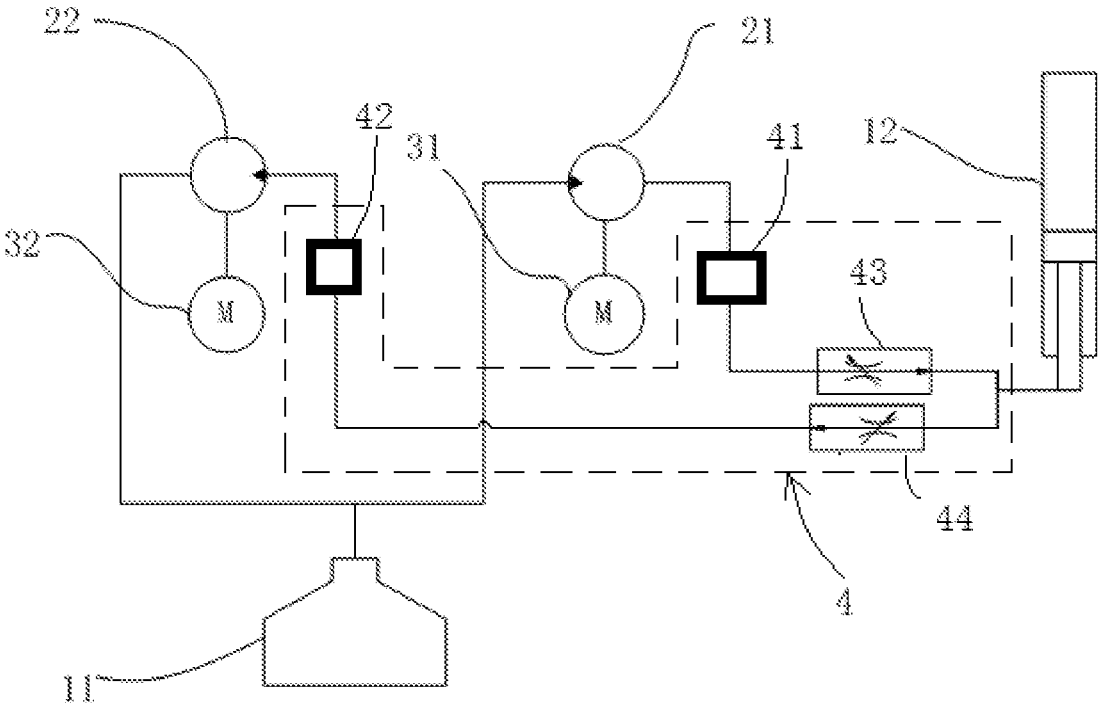
Figure 3:
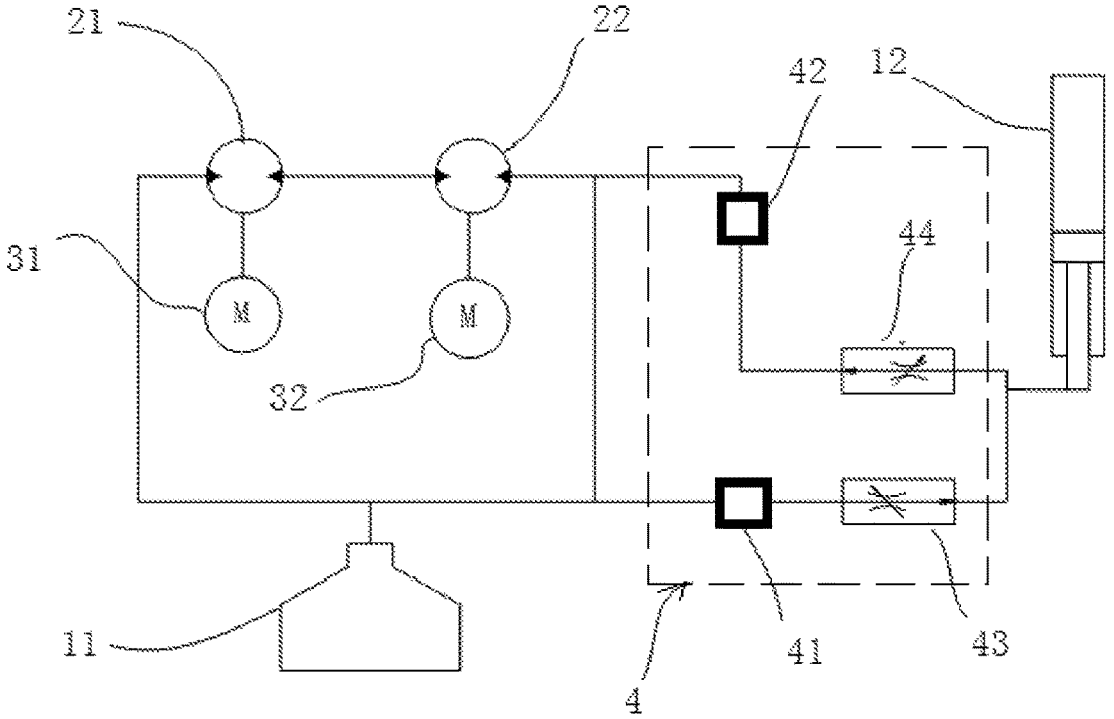

As shown in FIGS. 2-3, the hydraulic pump system may include a first hydraulic pump 21 and a second hydraulic pump 22. During the ascent of the lifting apparatus, the battery system 5 provides power for the first motor 31, the first motor 31 drives the first hydraulic pump 21 to rotate, the first hydraulic pump 21 draws liquid from the reservoir 11 and supplies the liquid to the liquid delivery system 4, the liquid delivery system 4 supplies the liquid to the hydraulic cylinder 12, and the hydraulic cylinder 12 converts hydraulic energy into mechanical energy to drive the lifting apparatus to ascend. During the descent of the lifting apparatus, the mechanical energy of the dynamic system for the lifting apparatus is converted into hydraulic energy to make the liquid in the hydraulic cylinder 12 flow to the liquid delivery system 4, the liquid flows to the second hydraulic pump 22 through the liquid delivery system 4 and drives the second hydraulic pump 22 to rotate, the second hydraulic pump 22 drives the second motor 32 to rotate, and the second motor 32 generates electric energy and provides the generated electric energy for the battery system 5, thereby charging the battery system 5.

Figure 4:
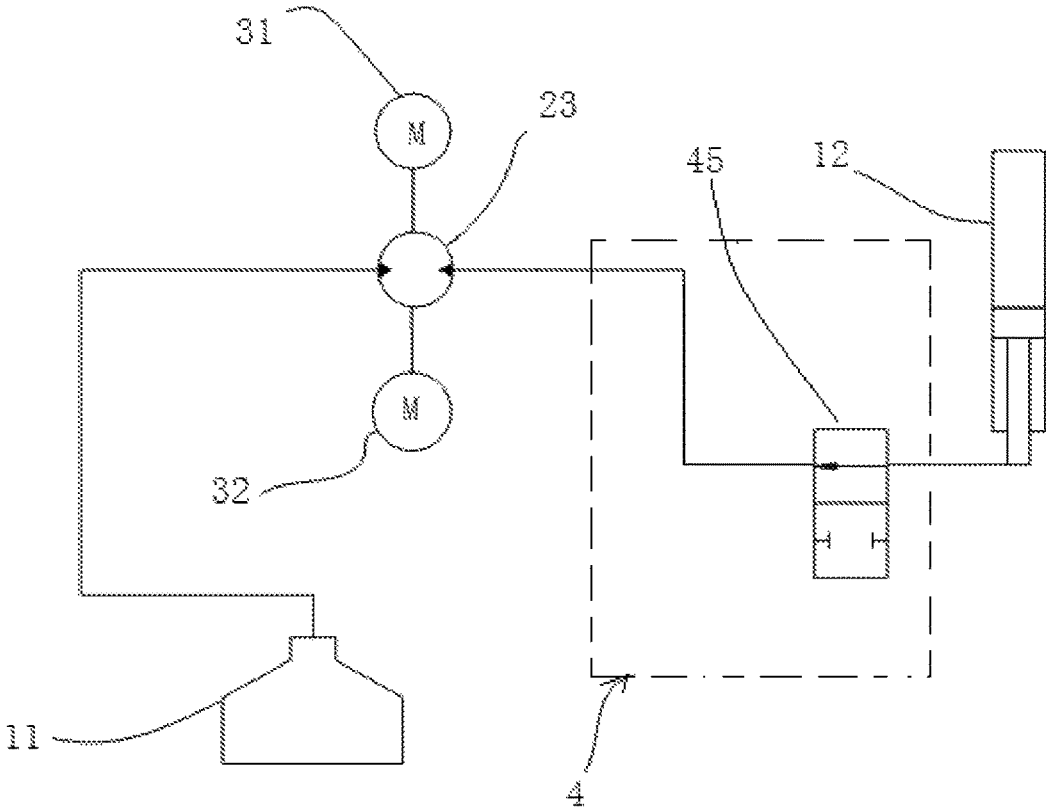
Figure 5:
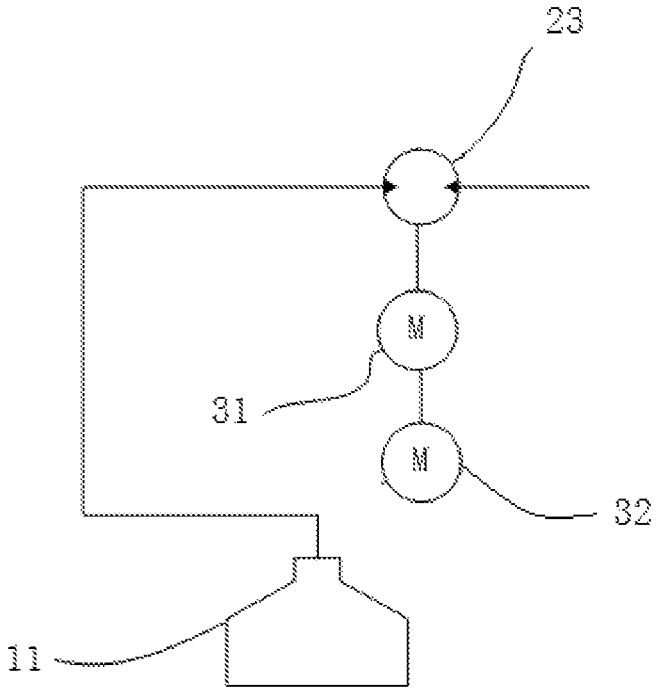
Figure 6:
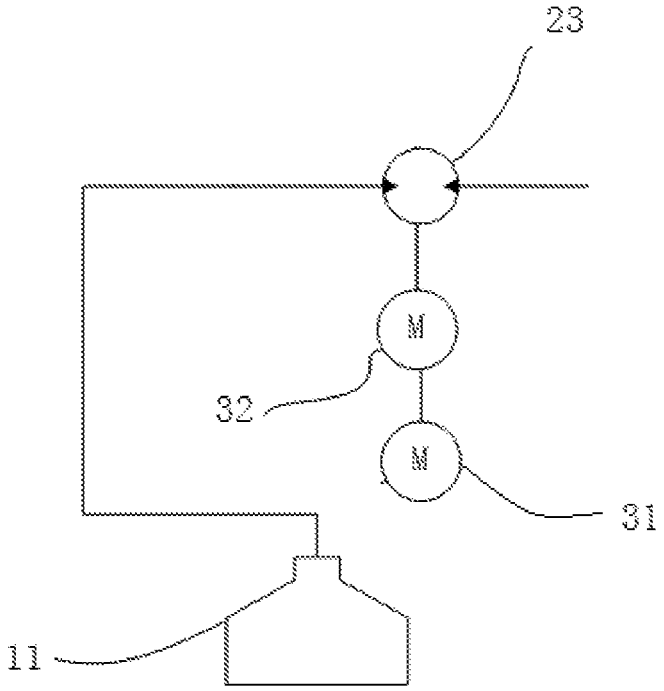
Figure 7:
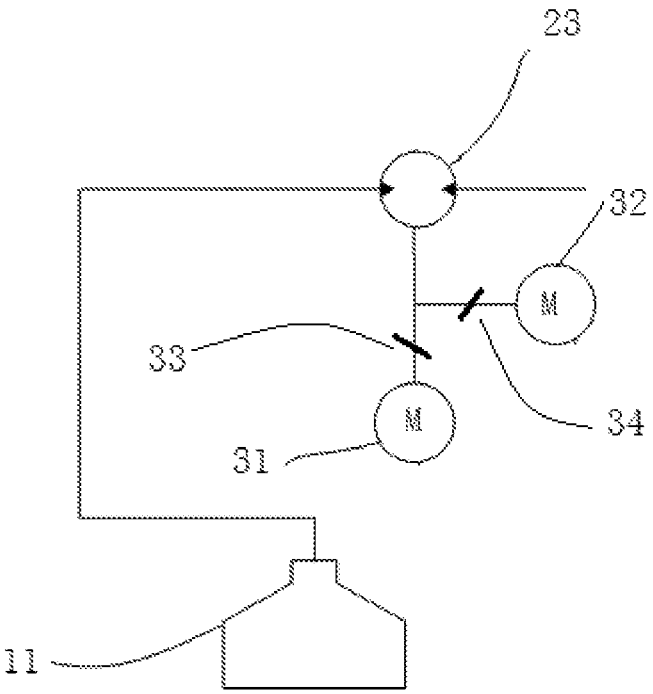
Figure 8:
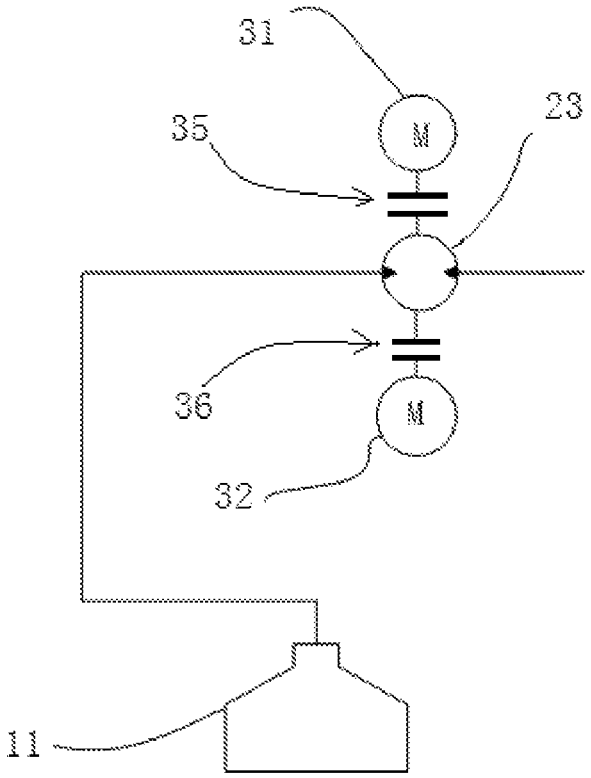

As shown in FIGS. 4-8, the hydraulic pump system may also include only one pump, i.e. a third hydraulic pump 23 without the first and second hydraulic pumps 21 and 22 as shown in FIGS. 2-3. During the ascent of the lifting apparatus, the first motor 31 drives the third hydraulic pump 23 to rotate in a first direction, the third hydraulic pump 23 draws liquid from the reservoir 11 and supplies the liquid to the liquid delivery system 4, the liquid delivery system 4 supplies the liquid to the hydraulic cylinder 12, and the hydraulic cylinder 12 converts hydraulic energy into mechanical energy to drive the lifting apparatus to ascend. During the descent of the lifting apparatus, the mechanical energy of the dynamic system for the lifting apparatus is converted into hydraulic energy to make the liquid in the hydraulic cylinder 12 flow to the liquid delivery system 4, the liquid flows to the third hydraulic pump 23 through the liquid delivery system 4 and drives the third hydraulic pump 23 to rotate in a second direction, the third hydraulic pump 23 drives the second motor 32 to rotate, and the second motor 32 generates electric energy and provides the generated electric energy for the battery system 5, thereby charging the battery system 5. As shown in FIGS. 4-6, the shaft of the third hydraulic pump 23, the shaft of the first motor 31 and the shaft of the second motor 32 are connected together, and the third hydraulic pump 23 is a two-way rotating pump. When the third hydraulic pump rotates in one direction, the lifting apparatus ascends correspondingly, the first motor 31 drives the third hydraulic pump 23, and the second motor 32 rotates freely accordingly but does not exchange energy and does not participate in driving. When the third hydraulic pump 23 rotates in the other direction, the lifting apparatus descends correspondingly, hydraulic pressure in the liquid delivery system 4 causes the third hydraulic pump 23 to rotate in the same direction, the third hydraulic pump 23 causes the second motor 32 to generate electric energy, and the first motor 31 rotates freely accordingly but does not exchange energy and does not participate in electric energy generation. As shown in FIG. 4, if the third hydraulic pump 23 is in a center position, the third hydraulic pump 23 adopts a mechanical shaft with two sides connections. Alternatively, as shown in FIG. 5, if the first motor 31 is in a center position, the first motor 31 adopts a mechanical shaft with two sides connections. Alternatively, as shown in FIG. 6, if the second motor 32 is in a center position, the second motor 32 adopts a mechanical shaft with two sides connections. As shown in FIG. 7, a gear box may be used to switch between two motor shafts. The shafts of the first motor 31 and the second motor 32 may correspond to two different gear positions of the gear box, namely a first gear position 33 and a second gear position 34. One of the first motor 31 and the second motor 32 can be coupled to the third hydraulic pump 23 according to different working modes by switching between the first and second gear positions 33, 34. In this way, a single two-way gear pump can be used to control two motors, and each of the two motors is responsible for work in one mode. As shown in FIG. 8, two clutch devices are adopted to achieve shaft coupling of the third hydraulic pump 23 and the two motors, wherein a first clutch device 35 and a second clutch device 36 are coupled with the shafts of the first motor 31 and the second motor 32 respectively, so that the two motors can be coupled with the third hydraulic pump 23 in different working modes.

In the dynamic system for the lifting apparatus provided in the present embodiment, the first motor 31 drives the hydraulic pump system 2 to rotate and provides hydraulic energy for the hydraulic cylinder 12, so as to realize high driving efficiency of the dynamic system for the lifting apparatus. The hydraulic cylinder 12 provides hydraulic energy for the hydraulic pump system 2 to make the hydraulic pump system 2 rotate and drive the second motor 32 to rotate, so that the second motor 32 generates electric energy and charges the battery system 5, realizing high energy recovery efficiency of the dynamic system. Since the first motor 31 and the second motor 32 are decoupled, the first motor 31 can have a high driving efficiency and the second motor 32 can have a high power generation efficiency. The problem that when only one motor is adopted, the motor needs to balance between driving efficiency and power generation efficiency is solved. The energy recovery rate of the technical solution according to the present invention can be increased from 10% in the prior art to about 30%.

Figure 9:
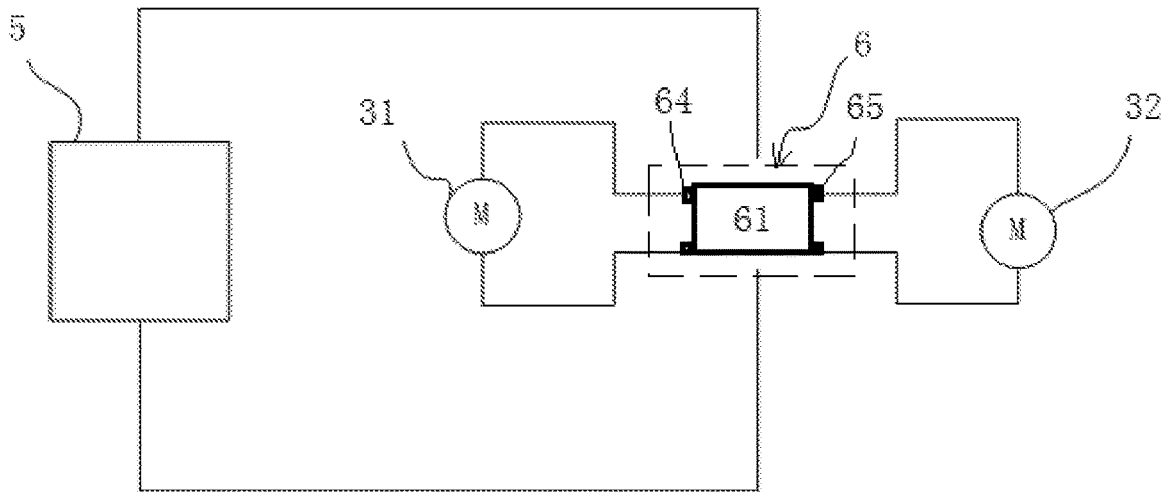

Specifically, in the dynamic system for the lifting apparatus, two independent electric drive components are arranged in the motor control unit to form two circuits, and the motor control unit may further include relays and the like. For example, the motor control unit 6 may comprise a motor controller and two motor interfaces. As shown in FIG. 9, the motor control unit 6 includes a first motor controller 61, a first motor interface 64 and a second motor interface 65. The first motor controller 61 is connected with the battery system 5, the first motor interface 64 is connected with the first motor 31, and the second motor interface 65 is connected with the second motor 32. During the ascent of the lifting apparatus, the first motor controller 61 allows, through the first motor interface 64, the first motor 31 to work alone to drive the liquid delivery system 4, and the second motor 32 does not participate in the supply of energy to the liquid delivery system 4. During the descent of the lifting apparatus, the first motor controller 61 allows, through the second motor interface 65, the second motor 32 to generate electric energy and provide the electric energy for the battery system 5, and the first motor 31 does not participate in the supply of energy to the battery system 5.

Figure 10:
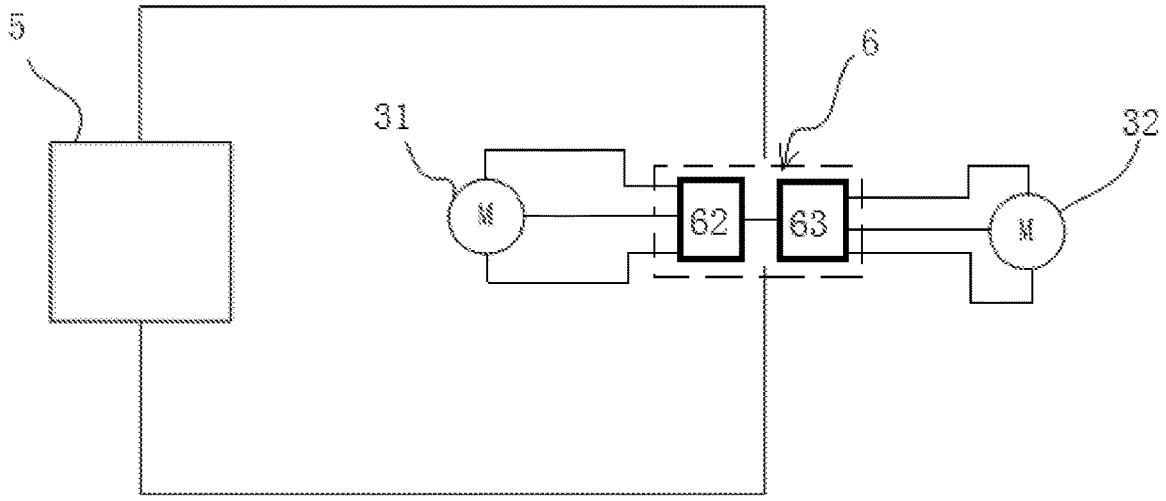

Alternatively, FIG. 10 shows another arrangement of the motor control unit 6. The motor control unit 6 may include a second motor controller 62 and a third motor controller 63. Both the second motor controller 62 and the third motor controller 63 are connected with the battery system 5, wherein the second motor controller 62 is connected with the first motor 31, and the third motor controller 63 is connected with the second motor 32. During the ascent of the lifting apparatus, the second motor controller 62 controls the first motor 31 to provide energy for the liquid delivery system 4, and the third motor controller 63 controls the second motor 32 not to participate in lifting operation and not to provide energy for the liquid delivery system 4. During the descent of the lifting apparatus, the third motor controller 63 controls the second motor 32 to generate electric energy and provide the electric energy for the battery system 5, and the second motor controller 62 controls the first motor 31 not to generate electric and not to provide the electric energy for the battery system 5. Specifically, a cable of each motor may be fixed to a binding post on the motor controller with a bolt (such as an M8 bolt), and the corresponding bolt constitutes the motor interface. The impedance change between the motor and the motor interface may be realized through an electronic switch inside the motor controller or realized by impedance change of the motor controller.

During the lifting operation, the first motor controller realizes the driving work only through the first motor by means of the first motor interface, and the second motor does not participate in the driving work. During descent control, the first motor controller realizes the power generation work only through the second motor by means of the second motor interface, and the first motor does not participate in the power generation work.

Figure 11:
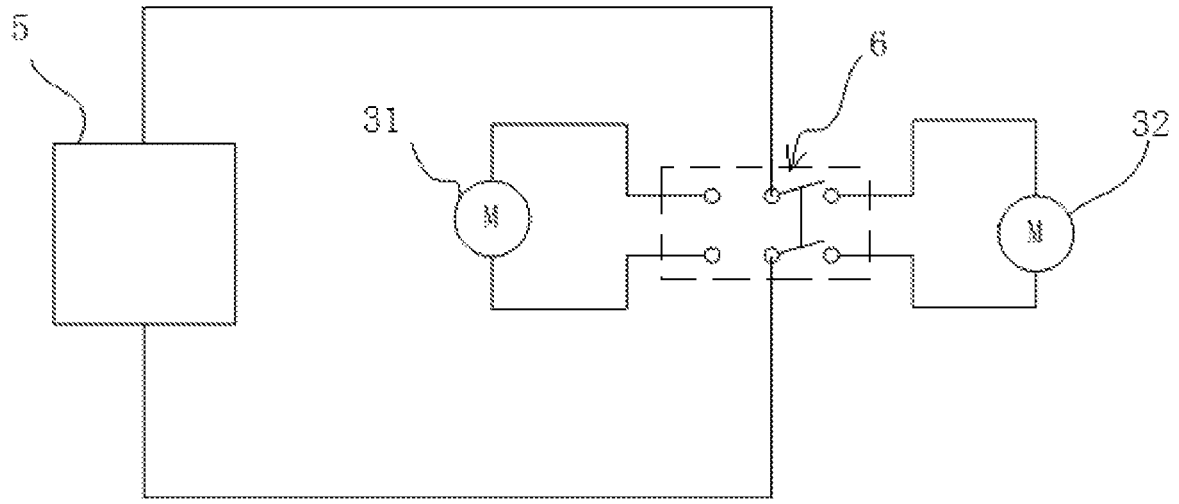

As shown in FIG. 11, the dynamic system for the lifting apparatus may further include a relay 6. The relay 6 may include a first circuit and a second circuit. The first circuit is connected between the first motor 31 and the battery system 5. The second circuit is connected between the second motor 32 and the battery system 5. According to a lifting state of the lifting apparatus, the relay 6 controls the first circuit to be disconnected and the second circuit to be conducted, or controls the second circuit to be disconnected and the first circuit to be conducted. By using the relay 6 to select only one from the first and the second circuits to be conducted according to the lifting state of the lifting apparatus, it is impossible for the first motor 31 and the second motor 32 to be electrified at the same time, which improves the reliability of the entire system and avoids the occurrence of wrong connection with positive and negative electrodes during motor driving and charging.

In addition, since the first motor and the second motor may each have two, three or four lead wires, the corresponding first motor interface and second motor interface should each have a corresponding number of binding posts and bolts. For example, as shown in FIG. 10, two three-phase motors are used each having three lead wires for connection, and the corresponding motor interface should have three binding posts for connecting the three lead wires. As shown in FIGS. 9 and 11, DC motors may be used to serve as the first motor and/or the second motor each requiring two lead wires or four lead wires for connection, and the corresponding motor interface should have two or four binding posts for connecting the lead wires. In order to reduce cost, motors having three lead wires are preferred in the present invention.

Further, in the dynamic system for the lifting apparatus, the rated power of the first motor is greater than the rated power of the second motor. Preferably, the rated power of the first motor is 1-2.5 times of the rated power of the second motor. Since energy is lost to some extent in output and recovery processes, the rated power of the first motor should be greater than the rated power of the second motor. Since the technical solution of the present invention can realize a high-efficiency energy recovery, the ratio of the rated power of the first motor to the rated power of the second motor may be reduced.

Further, the liquid delivery system in the present invention can also realize single-channel or dual-channel liquid delivery. In a single-channel design, a two-way liquid valve and a flow control means may be adopted to lower the cost and simplify the channel design. In a dual-channel design, each channel may be provided with a one-way liquid valve, the two one-way liquid valves being in opposite directions, and the reliability of the entire system can be improved. In addition, a first pipe and a second pipe can be used to divert the liquid so as to simplify the control method.

Figure 12:
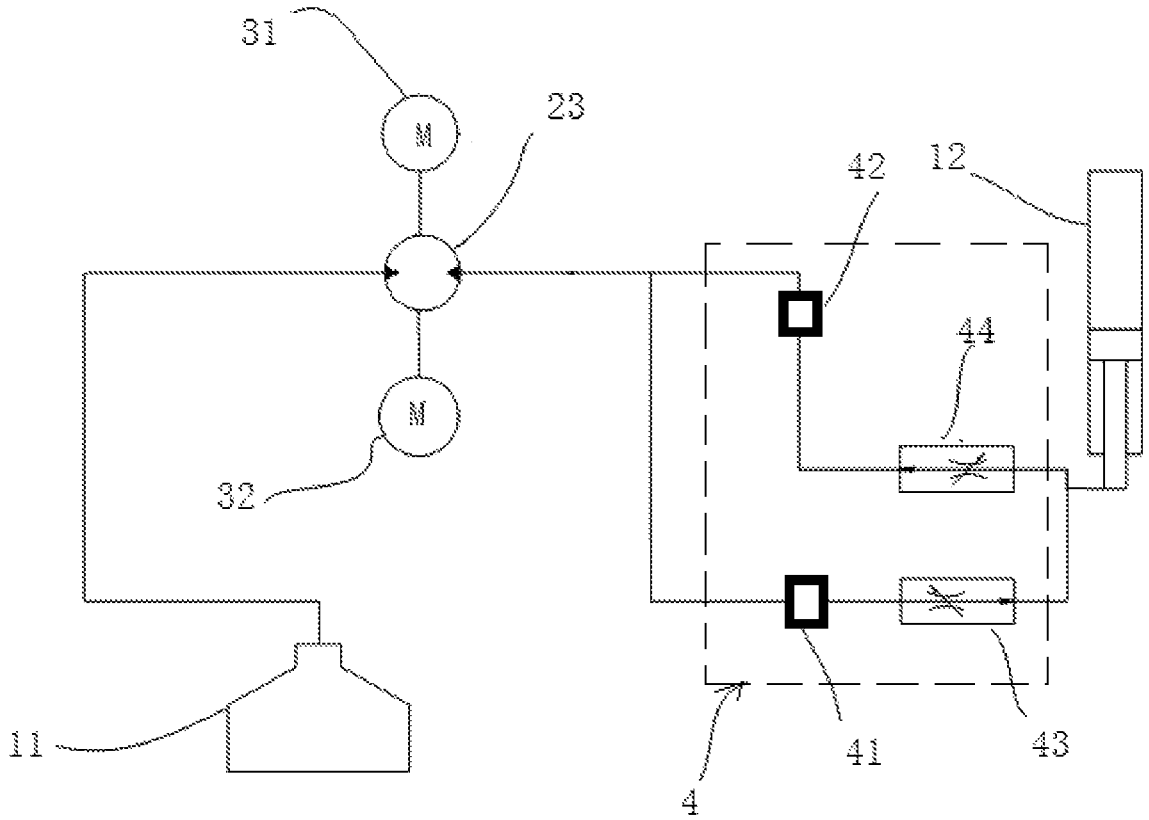

As shown in FIGS. 2-3, the liquid delivery system 4 may include a first pipe and a second pipe. The first pipe is connected between the hydraulic pump system 2 and the hydraulic cylinder 12, and the liquid in the first pipe flows from the hydraulic pump system 2 to the hydraulic cylinder 12. The second pipe is connected between the hydraulic pump system 2 and the hydraulic cylinder 12, and the liquid in the second pipe flows from the hydraulic cylinder 12 to the hydraulic pump system 2. As shown in FIGS. 2-3, there are two channels corresponding to a dual-pump structure, in FIG. 2, each channel corresponds to one pump; in FIG. 3, two channels are jointly connected with two pumps, and the control method is simpler. In FIG. 2, the first pipe is connected between the first hydraulic pump 21 and the hydraulic cylinder 12, and the liquid in the first pipe flows from the first hydraulic pump 21 to the hydraulic cylinder 12. The second pipe is connected between the second hydraulic pump 22 and the hydraulic cylinder 12, and the liquid in the second pipe flows from the hydraulic cylinder 12 to the second hydraulic pump 22. The liquid delivery system 4 uses the first pipe and the second pipe to divert the liquid. In FIG. 3, the first pipe and the second pipe are jointly connected with the second hydraulic pump 22, and the second hydraulic pump 22 is connected with the first hydraulic pump 21. The control method in FIG. 1 is more reliable, and the control method in FIG. 2 is relatively simple. FIGS. 2-3 correspond to a dual-channel dual-pump structure, and the two channels can also be matched with a single-pump structure, as shown in FIG. 12 specifically.

Specifically, the liquid delivery system 4 may further include a first valve 41 located in the first pipe and a second valve 42 located in the second pipe. Wherein the first valve 41 allows the liquid in the first pipe to flow from the hydraulic pump system (namely the first hydraulic pump 21) to the hydraulic cylinder 12; and the second valve 42 allows the liquid in the second pipe to flow from the hydraulic cylinder 12 to the hydraulic pump system (namely the second hydraulic pump 22). The first valve and the second valve may be one-way valves, two-way valves, or throttle valves which can completely shut off the liquid. The liquid delivery system 4 may further include a first throttle valve 43 located in the first pipe and a second throttle valve 44 located in the second pipe, which can effectively regulate liquid flow in the first pipe and the second pipe respectively. Wherein the first throttle valve 43 controls the liquid flow in the first pipe, and the second throttle valve 44 controls the liquid flow in the second pipe.

Figure 13:
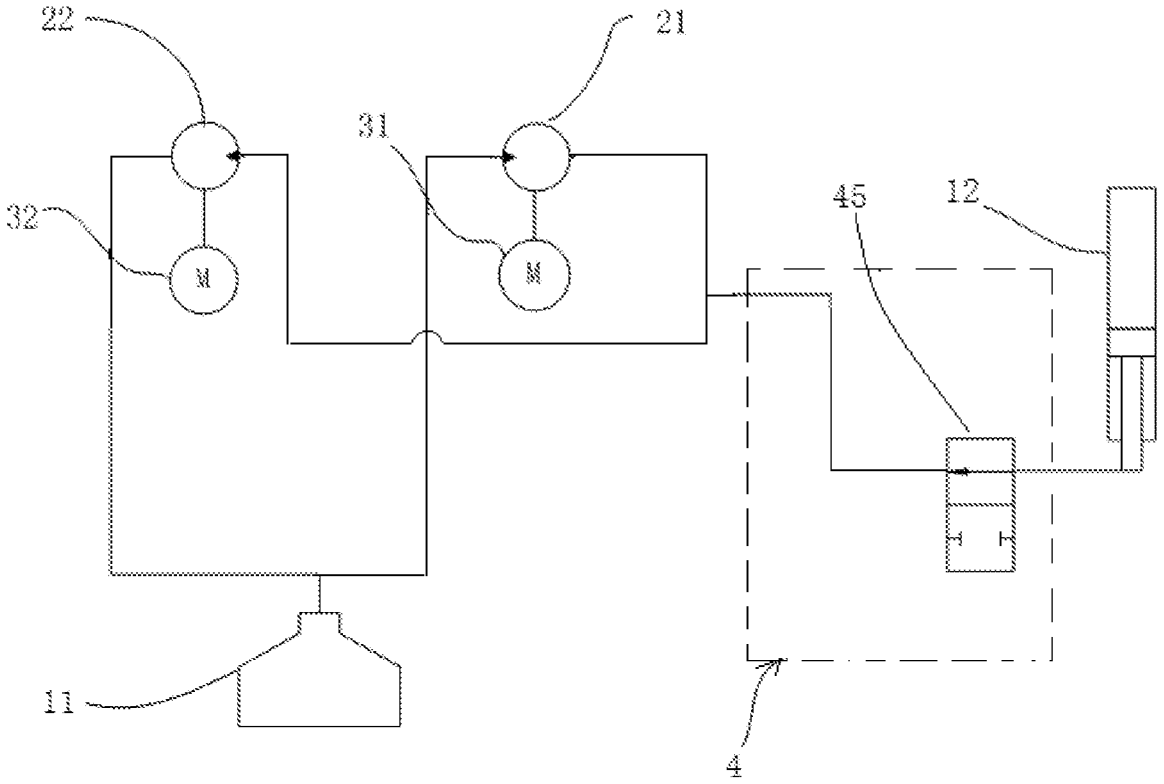

As shown in FIGS. 4-8, the liquid delivery system may include a third pipe, which is provided with a two-way valve 45. The two-way valve 45 allows the liquid in the third pipe to flow from the hydraulic pump system 2 to the hydraulic cylinder 12, or allows the liquid in the third pipe to flow from the hydraulic cylinder 12 to the hydraulic pump system 2. The two-way valve 45 may be a solenoid valve. FIGS. 4-8 correspond to embodiments of using a single-channel design. The two-way valve in the single channel is used to control the flow direction of the liquid. Although FIGS. 4-8 show a single-channel design with a single-pump structure, a single-channel design can also be implemented with a dual-pump structure, as shown in FIG. 13 specifically.

The hydraulic pump system in this embodiment can implement two schemes. In one scheme, a single pump controls two motors, and the two motors can be coupled through coaxial linkage, a two-way gear pump plus a gear box, a single clutch or two separated clutches and so on. In the other scheme, each of two pumps controls one motor, the directions of the liquid flowing through the two pumps being different, and the directions of rotation of the connected motors also being different.

Further, the liquid delivery system in the present invention can also realize single-channel or dual-channel liquid delivery. In a single-channel design, a two-way liquid valve and a flow control means may be adopted to lower the cost and simplify the channel design. In a dual-channel design, each channel may be provided with a one-way liquid valve, the two one-way liquid valves being in opposite directions, and the reliability of the entire system can be improved. In addition, a first pipe and a second pipe can be used to divert the liquid so as to simplify the control method.

In addition, various methods for connecting the two motors to the battery system can be adopted. Either two controllers or a single controller can be used to prevent the first motor and the second motor from being electrified at the same time, so as to avoid the occurrence of the wrong connection with positive and negative electrodes during motor driving and charging.

In summary, the above embodiments describe different configurations of the dynamic system for the lifting apparatus in detail. Of course, the present invention includes but is not limited to the configurations listed in the above embodiments, and any content that is transformed based on the configurations provided in the above embodiments belongs to the scope of the present invention.

What is claimed is:

1. A dynamic system for driving a lifting apparatus to ascend and descend, comprising a hydraulic cylinder, a liquid delivery system, a battery system, a motor control unit, a first motor, a second motor decoupled from the first motor, a hydraulic pump system and a reservoir, the hydraulic pump system comprising a single hydraulic pump, wherein:

during ascent of the lifting apparatus, the battery system provides power for the first motor through the motor control unit, the first motor driving the hydraulic pump to rotate in a first direction, the hydraulic pump drawing liquid from the reservoir and supplying the liquid to the liquid delivery system, the liquid delivery system supplying the liquid to the hydraulic cylinder, the hydraulic cylinder converting hydraulic energy into mechanical energy to drive the lifting apparatus to ascend; and during descent of the lifting apparatus, the mechanical energy of the dynamic system for the lifting apparatus is converted into hydraulic energy to make the liquid in the hydraulic cylinder flow to the liquid delivery system, the liquid flowing to the hydraulic pump through the liquid delivery system and driving the hydraulic pump to rotate in a second direction that is opposite to the first direction, the hydraulic pump driving the second motor to rotate, the second motor generating electric energy and providing the electric energy for the battery system through the motor control unit, thereby charging the battery system, wherein during ascent of the lifting apparatus, the hydraulic cylinder is solely supplied with the liquid drawn from the reservoir by the hydraulic pump rotating in the first direction, the hydraulic pump being solely driven by the first motor, wherein the first motor has a rated power greater than a rated power of the second motor.

2. The dynamic system according to claim 1, wherein the motor control unit comprises a first motor controller, a first motor interface and a second motor interface, the first motor controller being connected with the battery system, the first motor interface being connected with the first motor, the second motor interface being connected with the second motor, wherein:

during the ascent of the lifting apparatus, the first motor controller allows, through the first motor interface, the first motor to work solely to drive the liquid delivery system, and concurrently, the second motor does not participate in the driving of the liquid delivery system; and during the descent of the lifting apparatus, the first motor controller allows, through the second motor interface, the second motor to generate electric energy and solely provide the electric energy for the battery system, and concurrently, the first motor does not participate in the provision of electric energy to the battery system.

3. The dynamic system according to claim 1, wherein the motor control unit comprises a second motor controller and a third motor controller, both the second motor controller and the third motor controller being connected with the battery system, the second motor controller being connected with the first motor, the third motor controller being connected with the second motor, wherein:

during the ascent of the lifting apparatus, the second motor controller controls the first motor to solely drive the liquid delivery system, and concurrently, the third motor controller controls the second motor not to participate in the driving of the liquid delivery system; and during the descent of the lifting apparatus, the third motor controller controls the second motor to generate electric energy and solely provide the electric energy for the battery system, and concurrently, the second motor controller controls the first motor not to generate electric energy and not to participate in the provision of electric energy to the battery system.

4. The dynamic system according to claim 1, wherein the hydraulic delivery system comprises a first pipe and a second pipe, wherein:

the first pipe is connected between the hydraulic pump system and the hydraulic cylinder, and liquid in the first pipe flows from the hydraulic pump system to the hydraulic cylinder; and the second pipe is connected between the hydraulic pump system and the hydraulic cylinder, and liquid in the second pipe flows from the hydraulic cylinder to the hydraulic pump system.

5. The dynamic system according to claim 4, wherein the liquid delivery system further comprises a first valve located in the first pipe and a second valve located in the second pipe, wherein:

the first valve allows the liquid in the first pipe to flow from the hydraulic pump system to the hydraulic cylinder; and the second valve allows the liquid in the second pipe to flow from the hydraulic cylinder to the hydraulic pump system.

6. The dynamic system according to claim 4, wherein the hydraulic delivery system further comprises a first throttle valve located in the first pipe and a second throttle valve located in the second pipe, wherein:

the first throttle valve controls a liquid flow in the first pipe; and the second throttle valve controls a liquid flow in the second pipe.

7. The dynamic system according to claim 1, wherein the liquid delivery system comprises a third pipe, the third pipe having a two-way valve therein, the two-way valve allowing liquid in the third pipe to flow from the hydraulic pump system to the hydraulic cylinder or allowing liquid in the third pipe to flow from the hydraulic cylinder to the hydraulic pump system.

8. The dynamic system according to claim 1, further comprising a gear box that switches a coupling of the third hydraulic pump between a shaft of the first motor and a shaft of the second motor.

9. The dynamic system according to claim 8, wherein the motor control unit comprises a first motor controller, a first motor interface and a second motor interface, the first motor controller being connected with the battery system, the first motor interface being connected with the first motor, the second motor interface being connected with the second motor, wherein:

during the ascent of the lifting apparatus, the first motor controller allows, through the first motor interface, the first motor to work solely to drive the liquid delivery system, and concurrently, the second motor does not participate in the driving of the liquid delivery system; and during the descent of the lifting apparatus, the first motor controller allows, through the second motor interface, the second motor to generate electric energy and solely provide the electric energy for the battery system, and concurrently, the first motor does not participate in the provision of electric energy to the battery system.

10. The dynamic system according to claim 9, wherein the hydraulic delivery system comprises a first pipe and a second pipe, wherein:

the first pipe is connected between the hydraulic pump system and the hydraulic cylinder, and liquid in the first pipe flows from the hydraulic pump system to the hydraulic cylinder; and the second pipe is connected between the hydraulic pump system and the hydraulic cylinder, and liquid in the second pipe flows from the hydraulic cylinder to the hydraulic pump system.

11. The dynamic system according to claim 10, wherein the liquid delivery system further comprises a first valve located in the first pipe and a second valve located in the second pipe, wherein:

the first valve allows the liquid in the first pipe to flow from the hydraulic pump system to the hydraulic cylinder; and the second valve allows the liquid in the second pipe to flow from the hydraulic cylinder to the hydraulic pump system.

12. The dynamic system according to claim 11, wherein the hydraulic delivery system further comprises a first throttle valve located in the first pipe and a second throttle valve located in the second pipe, wherein:

the first throttle valve controls a liquid flow in the first pipe; and the second throttle valve controls a liquid flow in the second pipe.

* * * * *